United States Patent [19]

Knoble et al.

[11] 4,275,337

[45] Jun. 23, 1981

[54] STARTING AND OPERATING CIRCUIT FOR GASEOUS DISCHARGE LAMPS

[75] Inventors: David W. Knoble, East Flat Rock; Thomas A. Crane, Asheville, both of N.C.

[73] Assignee: General Electric Company, Schenectady, N.Y.

[21] Appl. No.: 64,865

[22] Filed: Aug. 8, 1979

[51] Int. Cl.[3] ..... H05B 37/00; H05B 41/00

[52] U.S. Cl. ..... 315/289; 315/239; 315/244; 315/280; 315/DIG. 7

[58] Field of Search ..... 315/290, 289, DIG. 7, 315/239, 240, 227 R, 244, 276, 280, 283

[56] References Cited

U.S. PATENT DOCUMENTS

| | | | |
|---|---|---|---|
| 3,235,769 | 12/1962 | Wattenbach | 315/240 |
| 3,917,976 | 11/1975 | Nuckolls | 315/283 |
| 3,963,958 | 6/1976 | Nuckolls | 315/276 |
| 3,976,910 | 8/1976 | Owens et al. | 315/283 |
| 4,005,336 | 1/1977 | Casella | 315/240 |
| 4,143,304 | 3/1979 | Hitchcock et al. | 315/276 |

OTHER PUBLICATIONS

General Electric Wiring Diagram 35-214290, dated 10/17/72, G.E. dwg. 35-204555, dated 5/2/73, G.E. ML35-976452-04, dated 11/79.

*Primary Examiner*—Alfred E. Smith
*Assistant Examiner*—Thomas P. O'Hare
*Attorney, Agent, or Firm*—Sidney Greenberg; Lawrence R. Kempton; Philip L. Schlamp

[57] ABSTRACT

Starting and operating circuit for gaseous discharge lamps has device for quickly re-starting extinguished lamps while still hot. Circuit comprises ballast reactor, pulse transformer having a magnetic core formed with an air gap, charging capacitor and voltage sensitive switch device connected to the pulse transformer to form a series discharge loop with a portion of the transformer, and a storage capacitor connected at the output of the ballast reactor having sufficiently high capacitance to provide, in combination with the pulse transformer, for hot re-start of the lamp.

12 Claims, 5 Drawing Figures

STARTING AND OPERATING CIRCUIT FOR GASEOUS DISCHARGE LAMPS

The present invention relates to discharge lamp operating and starting circuits, and particularly concerns a lamp starting circuit for re-starting high intensity gaseous discharge lamps.

Known types of circuits for starting and ballasting high intensity discharge lamps have the disadvantage that when power is briefly removed from the system, the lamp rapidly de-ionizes and ceases to conduct current upon re-application of power. This temporary outage may last from about 1 minute up to as much as 15 minutes depending on lamp type and cause interruption of work operations or other activities until the lamp is re-started. In the past, various devices for quickly re-starting the lamp have been suggested, but known devices and circuits of this type have generally been expensive, complicated in structure or unreliable in operation.

It is object of the invention to provide an improved device for starting and operating gaseous discharge lamps.

A particular object of the invention is to provide a device of the above type for quickly re-starting extinguished discharge lamps while still hot.

Still another object of the invention is to provide a device of the above type which is simple and economical in construction and reliable in operation.

A further object of the invention is to provide a device of the above type which may be employed with different lamp ballasts of conventional type.

Still another object of the invention is to provide a device of the above type which may employ pulse transformers of a wide variety of types.

Other objects and advantages will become apparent from the following description and the appended claims.

With the above objects in view, the present invention in one of its aspects relates to a starting and operating circuit for gaseous discharge lamps comprising, in combination, a source of alternating current, ballast induction means connected at its input side to the alternating current source, pulse transformer means connected in series to the output of the ballast induction means, discharge lamp means connected at one side to the output of the pulse transformer means, and at the other side to the alternating current source, storage capacitor means connected to the junction of the ballast induction means and the pulse transformer means across the alternating current source, the pulse transformer means comprising a magnetic core formed with at least one gap therein and induction coil means on the magnetic core, high voltage starting means including a portion of the induction coil means for providing a high voltage starting pulse on the discharge lamp means, the ratio L/C, where L is the inductance of the pulse transformer means and C is the capacitance of the storage capacitor means, being less than about 64,000 ohms$^2$.

The invention will be better understood from the following description taken with the accompanying drawings, in which.

Figure 1:
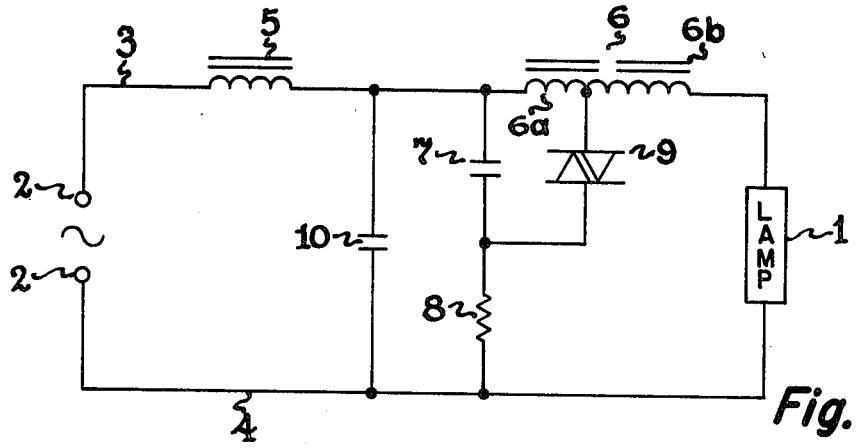
FIG. 1 is a circuit diagram of a discharge lamp starting and operating circuit in accordance with an embodiment of the invention.

Referring now to the drawings, and particularly to FIG. 1, there is shown a starting and operating circuit for a gaseous discharge lamp 1, such as a high pressure sodium or other metal vapor lamp, which requires a relatively high voltage pulse in order to be ignited and which thereafter operates on a lower voltage. Lamp 1 is connected by line conductors 3 and 4 across terminals 2 of an alternating current source, with inductive reactance ballast 5, such as in the form of an iron core induction coil, connected in series therewith to provide a current limiting impedance, as is conventional in discharge lamp circuits. A high voltage generator for starting the lamp comprises pulse transformer 6, having a structure as more fully described below, connected in series between reactor ballast 5 and lamp 1, and a starting circuit comprising charging capacitor 7 and resistor 8 connected in series across lamp 1 at the input side of pulse transformer 6, and a voltage sensitive symmetrical switch 9, such as a power diac, which is a bi-laterally conducting semiconductor device which becomes conductive only upon application of a predetermined voltage thereto. Semiconductor switch 9 is connected at one side to the junction of capacitor 7 and resistor 8 and at the other side to a tap on pulse transformer 6 so as to be connected across capacitor 7 and a predetermined number of turns **6*a* of the pulse transformer at its input end, so that semiconductor switch 9 is in series discharge relation with capacitor 7 and the tapped turns 6*a* of transformer 6** in series therewith.

The number of turns tapped off at the input end of transformer 6 should be sufficient to adequately couple in an autotransformer action the high voltage across the entire winding of the transformer coil. In a typical arrangement in the FIG. 1 embodiment, the ratio of total turns to tapped turns selected may be about 30 to 1, which usually suffices to provide good coupling and adequate peak output voltage for starting lamp 1.

While the particular arrangement of capacitor 7 and switch 9 as shown in FIG. 1 is preferred, the positions of these two components may be interchanged if desired.

Connected to the junction of ballast reactor 5 and pulse transformer 6 and across terminals 2 is storage capacitor 10, which co-acts with pulse transformer 6 in accordance with the invention to provide sufficient energy to rapidly re-start lamp 1 in the event the lamp is extinguished.

Capacitor 10 is selected to have an impedance substantially greater than the impedance of ballast reactor 5. If the impedance of capacitor 10 is lower than that of ballast reactor 5, a larger leading current is drawn from the supply, requiring the use of larger conductors in the circuit and thus increasing the cost. Where the impedances of capacitor 10 and ballast reactor 5 are substantially the same, excessive voltage and current is produced in the circuit and inadequate ballasting of the discharge lamp may result.

In accordance with a further feature of the invention, capacitor 10 and pulse transformer 6 are selected such that their impedances have a desired relationship. This relationship may be expressed in terms of the ratio L/C where L is the inductance of pulse transformer 6 and C is the capacitance of storage capacitor 10, and in accordance with the invention these components are so related that the ratio L/C is less than about 64,000 ohms$^2$. In a typical circuit, L/C is preferably in the range of about 10,000 to about 20,000 ohms$^2$. The values of L and C are chosen such that the rate of rise of current through the lamp when the lamp has been newly ionized during the re-striking stage will be at or above a critical value, in order to maintain and increase the degree of ionization in the lamp arc tube. The rate of rise of this current is inversely proportional to the ratio L/C. Accordingly, the lower this ratio, the more readily is the hot re-starting of lamps achieved, especially for higher voltage lamps. While theoretically any ratio value below 64,000 ohms$^2$ would be effective for hot re-starting of gaseous discharge lamps, as a practical matter ratios of less than about 5,000 ohms$^2$ would not be feasible because of the excessive cost of capacitors, pulse transformers or switching components which would be needed to provide such low ratios.

In accordance with the invention, resistor 8 in series with charging capacitor 7 should have sufficiently low resistance to provide for multiple starting pulses, typically five, per half-cycle to facilitate lamp starting and re-starting.

Figure 2:
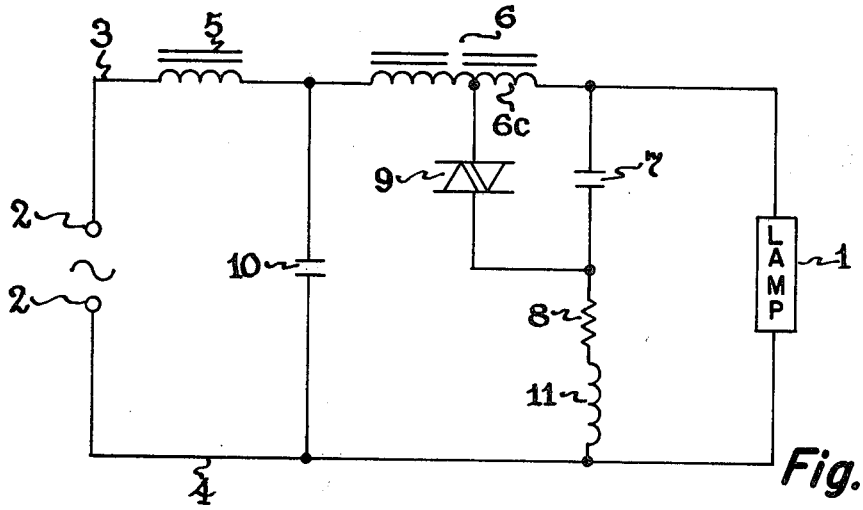
FIG. 2 is a circuit diagram showing a modification of the FIG. 1 embodiment.

FIG. 2 shows a modification of the FIG. 1 circuit, wherein the series discharge loop comprising capacitor 7 and voltage sensitive switch 9 is arranged at the output end of pulse transformer 6 and includes tapped coil turns 6*c* at that end, in contrast to the FIG. 1 embodiment wherein the discharge loop is located at the input end. Also shown in the FIG. 2 modification is the provision of an inductor 11 in series with resistor 8, for the purpose of preventing undue loading of the starting pulse by the discharge loop.

Figure 3:
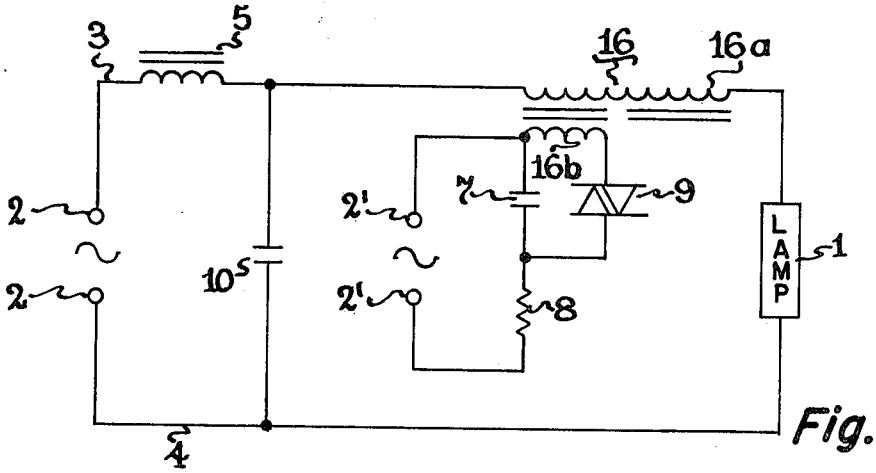
FIG. 3 is a circuit diagram of an embodiment of the invention having a different form of pulse transformer.
Figure 4:
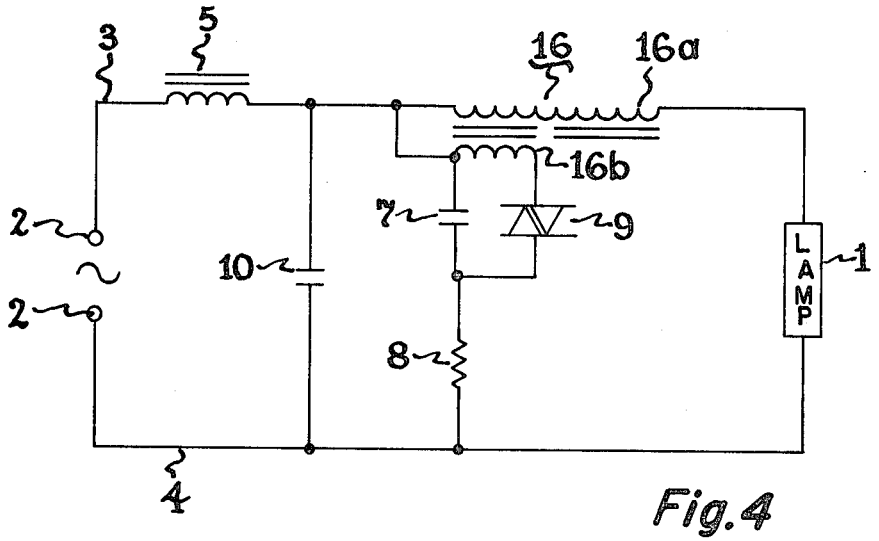
FIG. 4 is a circuit diagram showing a modification of the FIG. 3 embodiment.

FIGS. 3 and 4 show other modifications of the FIG. 1 device, wherein pulse transformer 16 has isolated windings 16*a*, 16*b*. In the FIG. 3 version the secondary winding 16*b* is connected to terminals 2' of an auxiliary power source, either alternating or direct current. The voltage of this auxiliary source should be sufficiently high, typically 120 volts, to operate the pulse generating starting circuit at a sufficiently rapid rate to effectively ionize the lamp when being hot re-started. As will be evident, the starting circuit in the FIG. 3 version will operate continuously.

While transformer windings 16*a*, 16*b* are isolated from one another as shown in FIG. 3, these windings are considered to be electrically connected, as that expression is used herein.

In the FIG. 4 embodiment, the starting circuit is connected to the line conductor of main supply source 2,2 instead of a separate power source, thus avoiding the continuous operation characterizing the FIG. 3 starting circuit.

Figure 5:
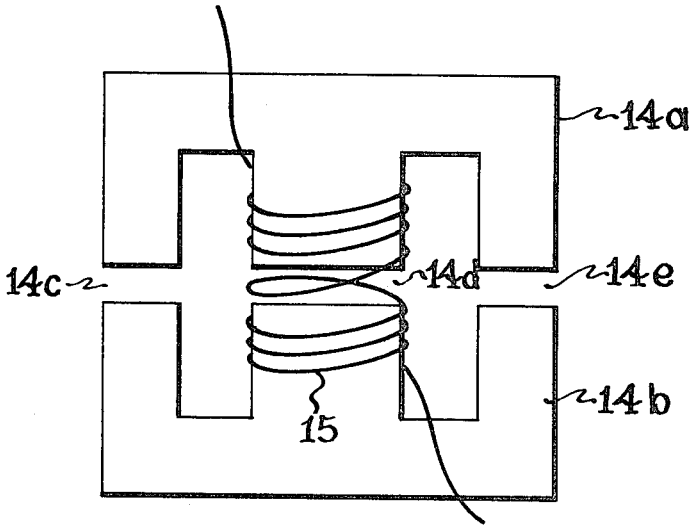
FIG. 5 is a diagrammatic view of a pulse transformer core and coil arrangement which may be employed in the device of the invention.

In accordance with another feature of the invention, pulse transformer 6 comprises a magnetic core 6*b* having an air gap to provide the desired series reactance of the pulse transformer. Preferably, a ferrite core is employed for improved performance at high frequencies, but pulse transformers of a wide variety of known types and structures may be employed in practicing the invention. Shown in FIG. 5 is an example of a pulse transformer structure which may be employed. The illustrated pulse transformer is formed of an E-E core comprising portions 14*a*, 14*b* having air gaps 14*c, d, e* between adjoining legs, and a coil 15 arranged on the central leg of the core. As will be understood, the air gaps will, in practice, be occupied by suitable electrical insulation, and the parts of the core will be held in assembly by suitable means (not shown). In accordance with the invention, the air gaps are sufficiently large to provide the desired series reactance of the pulse transformer. If the total air gap is too small, the pulse transformer has a high series reactance (for a period of time until the core saturates), with the result that the energy stored on capacitor 10 cannot be delivered to the lamp in sufficient time to maintain the ionization of the lamp gases. On the other hand, if the air gap is too large, the magnetizing reactance of the pulse transformer is too small, resulting in reduced output voltage and increased power dissipated in the semiconductor switch 9.

Forms of the core other than the E-E type illustrated may be used, such as E-I, U-U, U-I, or toroidal types, it being understood that the particular core used will have an air gap of the required size as explained above.

It will also be understood that inductive ballast devices of types different from the ballast reactor 5 illustrated may be employed in place of the latter, such as, for example, an autotransformer, isolation transformer, or other known types of inductive ballasts.

Types of voltage sensitive switches other than the switch illustrated may alternatively be employed, as for example a triac, neon glow lamp, of Shockley diode, and including both bi-lateral and unilateral conducting types.

In a typical circuit such as depicted in FIG. 1 which has provided satisfactory results in accordance with the invention, lamp 1 was a 150 watt high pressure sodium vapor lamp, the line voltage was 120 volts a-c at 60 Hertz, ballast reactor 5 had an impedance of 25 ohms, capacitor 10 was 2 microfarads with an impedance of 1300 ohms. Pulse transformer 6 had a coil of 304 turns of 0.043" copper wire with a tap at 296 turns, and having 24 turns per layer, and the core comprised two ferrite E-cores arranged as shown in FIG. 5, with gaps in all three legs, each gap being 0.040". Pulse transformer 6 had an inductance of 0.032 henries, providing an impedance of 12 ohms, thus resulting in an L/C ratio of about 16,000 ohms$^2$. Switch 9 was a sidac having 120 volt breakdown voltage. Resistor 8 had a value of 600 ohms, and capacitor 7 was 1 microfarad.

The above described circuit was found to hot re-start the lamp in less than one-half second.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A starting and operating circuit for gaseous discharge lamps comprising, in combination, a source of alternating current, ballast induction means connected at its input side to said alternating current source, pulse transformer means connected in series to the output of said ballast induction means, discharge lamp means connected at one side to the output of said pulse transformer means, and at the other side to said alternating current source, storage capacitor means connected to the junction of said ballast induction means and said pulse transformer means across said alternating current source, said pulse transformer means comprising a magnetic core formed with at least one gap therein and induction coil means on said magnetic core, high voltage starting means including a portion of said induction coil means for providing a high voltage starting pulse on said discharge lamp means, the ratio L/C, where L is the inductance of said pulse transformer means and C is the capacitance of said storage capacitor means, being less than about 64,000 ohms$^2$.

2. A circuit as defined in claim 1, said high voltage starting means comprising a charging capacitor and resistor connected in series across said discharge lamp means, and voltage sensitive switch means having a predetermined breakdown voltage connected across said charging capacitor, said charging capacitor and said voltage sensitive switch means being electrically connected to said portion of said induction coil means and forming a series discharge loop therewith for generating high frequency starting pulses.

3. A circuit as defined in claim 2, wherein the ratio L/C is in the range of about 10,000 ohms$^2$ to about 20,000 ohms$^2$.

4. A circuit as defined in claim 1, the impedance of said storage capacitor being substantially greater than the impedance of said ballast induction means.

5. A circuit as defined in claim 2, the resistance of said resistor being sufficiently low to provide for multiple pulses per half-cycle for starting said discharge lamp means.

6. A circuit as defined in claim 2, said portion of said induction coil means being at the input side of said induction coil means.

7. A circuit as defined in claim 2, said portion of said induction coil means being at the output side of said induction coil means, and inductor means connected in series with said resistor and said charging capacitor.

8. A circuit as defined in claim 2, said core of said pulse transformer means being formed of ferrite.

9. A circuit as defined in claim 2, said portion of said induction coil means being in isolated, inductively coupled relation to the remainder of said induction coil means.

10. A circuit as defined in claim 2, said switch means comprising a symmetrical semiconductor switch.

11. A circuit as defined in claim 6, said voltage sensitive switch means connected to a tap on said induction coil means defining said portion thereof, said charging capacitor being connected to the input end of said induction coil means.

12. A circuit as defined in claim 11, the impedance of said storage capacitor being substantially greater than the impedance of said ballast induction means, the ratio L/C being in the range of about 10,000 ohms$^2$ to about 20,000 ohms$^2$.

* * * * *